US006948607B2

(12) United States Patent
Ito et al.

(10) Patent No.: US 6,948,607 B2
(45) Date of Patent: Sep. 27, 2005

(54) SHEET HANDLING APPARATUS AND METHOD FOR OPENING/CLOSING SHEET TRANSPORT PATH IN THE HANDLING APPARATUS

(75) Inventors: Yukio Ito, Chiyoda-ku (JP); Hideo Tanaka, Chiyoda-ku (JP); Shigeru Yasuda, Chiyoda-ku (JP)

(73) Assignee: Nippon Conlux Co., Ltd. (JP)

( * ) Notice: Subject to any disclaimer, the term of this patent is extended or adjusted under 35 U.S.C. 154(b) by 29 days.

(21) Appl. No.: 10/240,369

(22) PCT Filed: Jan. 31, 2002

(86) PCT No.: PCT/JP02/00775

§ 371 (c)(1),
(2), (4) Date: Sep. 27, 2002

(87) PCT Pub. No.: WO02/060797

PCT Pub. Date: Aug. 8, 2002

(65) Prior Publication Data

US 2003/0137095 A1 Jul. 24, 2003

(30) Foreign Application Priority Data

Jan. 31, 2001 (JP) ..... 2001-023236

(51) Int. Cl.[7] ..... G07F 7/04

(52) U.S. Cl. ..... 194/206; 194/207; 271/177; 271/181

(58) Field of Search ..... 271/177, 180, 271/181; 194/206, 207

(56) References Cited

U.S. PATENT DOCUMENTS

| | | | | |
|---|---|---|---|---|
| 5,564,691 A | * | 10/1996 | Hatamachi et al. | 271/178 |
| 5,730,271 A | * | 3/1998 | Buchman et al. | 194/206 |
| 5,899,452 A | * | 5/1999 | Walsh | 271/180 |
| 6,241,240 B1 | * | 6/2001 | Bukhman | 271/214 |
| 6,394,444 B1 | * | 5/2002 | Ito et al. | 271/180 |
| 6,543,763 B2 | * | 4/2003 | Ito et al. | 271/178 |

FOREIGN PATENT DOCUMENTS

JP 8-104453 A 4/1996

* cited by examiner

*Primary Examiner*—David H. Bollinger
(74) *Attorney, Agent, or Firm*—Rossi & Associates

(57) ABSTRACT

In a paper-like piece handling apparatus, a same drive (M2) is shared between a stacker mechanism (11) for storing an inserted paper-like piece (P) into a cumulative paper-like piece storage section (20) and a shutter (10) for opening/closing a predetermined transport path (4). The shared use of the drive (M2) can reduce the number of necessary component parts and overall cost of the apparatus.

10 Claims, 8 Drawing Sheets

SHEET HANDLING APPARATUS AND METHOD FOR OPENING/CLOSING SHEET TRANSPORT PATH IN THE HANDLING APPARATUS

BACKGROUND

The present invention relates generally to paper-like piece handling apparatus for use in automatic vending machines, money changing machines and the like, which handle paper-like pieces such as bills (pieces of paper money or bank notes), tickets and cards, for evaluating the authenticity of inserted paper-like pieces and cumulatively storing those paper-like pieces having been ascertained as authentic. More particularly, the present invention relates to an improved paper-like piece handling apparatus including a means, such as a shutter, for opening and closing a paper-like piece transport path, and an improved method for opening/closing the paper-like piece transport path in such a paper-like piece handling apparatus.

Most of automatic vending machines and money changing machines include a certain type of paper-like piece handling apparatus which evaluates the authenticity of every inserted paper-like piece and cumulatively stores only paper-like pieces having been ascertained as authentic. Generally, the conventional paper-like piece handling apparatus include a transport mechanism for transporting each paper-like piece, inserted or deposited through an insertion opening, along a predetermined transport path, an evaluation means for evaluating the authenticity of the paper-like piece transported via the transport mechanism, and a stacker mechanism for storing each paper-like piece, ascertained as authentic, into a cumulative paper-like piece storage section. This type of paper-like piece handling apparatus is also equipped with a shutter for opening/closing the paper-like piece transport path with a view to preventing unfair acts by wicked persons, such as forcible pulling out of the inserted paper-like piece through the insertion opening.

Examples of the paper-like piece handling apparatus equipped with such a shutter are known, for example, from Japanese Utility Model Publication No. SHO-60-25643 and Japanese Patent Laid-open Publication No. HEI-7-249146. The first-mentioned No. SHO-60-25643 publication discloses a paper-like piece handling apparatus that uses a solenoid as a drive source for the shutter. In this paper-like piece handling apparatus, the solenoid is activated, in response to insertion of a paper-like piece, to retract the shutter from the transport path so as to clear or open the transport path. After the inserted paper-like piece has passed the shutter, the solenoid is deactivated to allow the shutter to advance into the transport path for blocking or closing the transport path. The second-mentioned No. HEI-7-249146 publication discloses a paper-like piece handling apparatus that includes a motor as a drive source for the shutter and a motor-motion conversion mechanism for converting the rotary motion of the motor into linear motion. Here, in response to insertion of a paper-like piece, the motor is activated to rotate in one direction and the rotary motion of the motor is converted via the conversion mechanism into linear motion to retract the shutter from the transport path so as to open the transport path. After the inserted paper-like piece has passed the shutter, the motor is activated again to rotate in another direction and the rotary motion, in the other direction, of the motor is converted via the conversion mechanism into linear motion to allow the shutter to advance into the transport path for closing the transport path.

Namely, these conventional paper-like piece handling apparatus are constructed to prevent paper-like pieces from being forcibly pulled out through the insertion opening by an unfair act, by causing the shutter to close the transport path after the introduction of each paper-like piece into the apparatus.

However, the above-mentioned conventional paper-like piece handling apparatus tend to become very costly, because they use the drive, such as the solenoid or motor, to move the shutter between the positions for opening and closing the transport path. Particularly, in the case where the motor is used as the drive for opening and closing the shutter, the separate conversion mechanism is required for converting the rotary motion of the motor into linear motion, which would add to the number of necessary component parts and hence unavoidably increase the overall cost of the apparatus.

SUMMARY OF THE INVENTION

It is therefore an object of the present invention to provide an improved paper-like piece handling apparatus and method for closing and opening a paper-like piece transport path which can achieve a reduced number of component parts and reduced overall cost of the apparatus by allowing a particular component to be shared for different functions.

In order to accomplish the above-mentioned object, the present invention provides a paper-like piece handling apparatus which comprises: transport means for transporting, along a transport path, a paper-like piece inserted through an insertion opening; transport path opening/closing means for closing or opening said transport path at a given enroute point of said transport path; paper-like piece evaluation means for evaluating authenticity of the inserted paper-like piece during transport of the paper-like piece along said transport path; and stacker means for storing the evaluated paper-like piece into a cumulative paper-like piece storage section, wherein said stacker means and said transport path opening/closing means are driven via same drive means. Because the same drive means is shared between the stacker means and the transport path opening/closing means, the present invention can significantly reduce the number of necessary component parts and overall cost of the apparatus.

According to another aspect of the invention, there is provided a method for opening/closing a transport path in a paper-like piece handling apparatus which comprises: transport means for transporting, along said transport path, a paper-like piece inserted through an insertion opening; transport path opening/closing means for closing or opening said transport path at a given enroute point of said transport path; paper-like piece evaluation means for evaluating authenticity of the inserted paper-like piece during transport of the paper-like piece along said transport path; and stacker means for storing the evaluated paper-like piece into a cumulative paper-like piece storage section, said stacker means and said transport path opening/closing means being driven via same drive means, said method comprising: a step of causing said paper-like piece evaluation means to evaluate the authenticity of the inserted paper-like piece, during transport of the paper-like piece along said transport path; a step of temporarily holding the paper-like piece in an intermediate position of the transfer path after a rear end of said paper-like piece being transported along the transpot path has passed the location of said transport path opening/closing means; a step of driving said stacker means via said drive means to move said stacker means to a predetermined stack standby position while the paper-like piece is temporarily held in the intermediate position, and causing said transport path opening/closing means to close said transport path in response to the driving via said drive means; a step of transporting the temporarily held paper-like piece from said intermediate position to a predetermined stacking position; and a step of stacking the paper-like piece from the predetermined stacking position into said cumulative paper-like piece storage section by driving said stacker means via said drive means to move said stacker means from said predetermined stack standby position toward said cumulative paper-like piece storage section, and causing said transport path opening/closing means to open said transport path in response to the driving via said drive means. Because the same drive means is shared between the operation for storing the paper-like piece into the cumulative paper-like piece storage section and the operation for opening/closing the transport path, the present invention can significantly reduce the number of necessary component parts and overall cost of the apparatus.

DETAILED DESCRIPTION

The preferred embodiments of the present invention will be described in greater detail hereinbelow with reference to the accompanying drawings.

Figure 1:
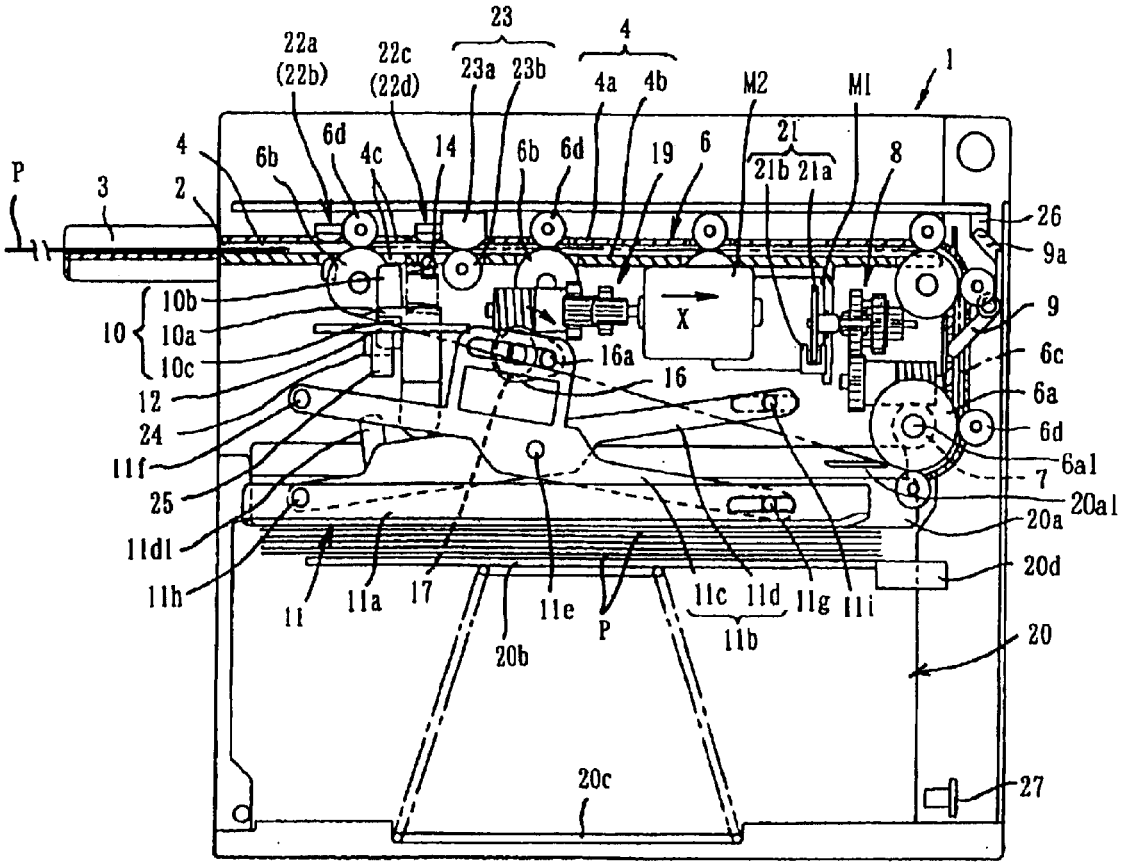
FIG. 1 is a vertical sectional view of a paper-like piece handling apparatus in accordance with an embodiment of the present invention, which is embodied as a bill handling apparatus.

FIG. 1 is a vertical sectional view of a paper-like piece or sheet handling apparatus in accordance with an embodiment of the present invention, which is embodied as a bill handling apparatus. Whereas the paper-like piece handling apparatus of the present invention will be described hereinbelow as embodied as an apparatus for handling bills (bank notes), the present invention may be arranged to handle other paper-like pieces than bills, such as tickets or cards.

Specifically, FIG. 1 shows the bill handling apparatus in a stand-by state ready to accept a bill inserted or deposited through a bill insertion opening 2. In FIG. 1, the bill handling apparatus includes a housing 1 having substantially equal vertical and horizontal dimensions. The housing 1 has the bill insertion opening 2 formed in an upper region of a front (left in the figure) wall portion thereof, and a bill insertion guide 3, projecting outward from the housing 1, is provided on the upper region of the front wall portion in alignment with the insertion opening 2. Bill is deposited longitudinally into the insertion opening 2 via the bill insertion guide 3. In an interior space enclosed by the housing 1, there is provided a bill transport path 4 along which the deposited bill P is transported. The bill transport path 4 is composed of a pair of opposed upper and lower transport path plates 4*a* and 4*b*, which has a substantial L configuration bent toward a bill introducing portion 20*a*1 of a cumulative bill storage section 20 provided in a lower area within the housing 1. Further, the bill transport path 4 is sized such that a total distance between a later-described shutter 10 and the upstream end of, or entrance to, the introducing portion 20*a*1 is slightly greater than the longitudinal dimension or length of the bill P.

In the embodiment of FIG. 1, the bill handling apparatus includes a transport mechanism 6 for transporting the inserted bill P along the transport path 4, i.e., the pair of opposed upper and lower transport path plates 4*a* and 4*b*. Specifically, the transport mechanism 6 includes two belt transport mechanisms disposed near opposite side edge portions of the lower transport path plate 4*b* (and hence the inserted bill P); namely, the two belt transport mechanisms are paced from each other in a widthwise direction of the lower transport path plate 4*b*. Each of the belt transport mechanisms includes a driving timing pulley 6*a*, a plurality of (in the illustrated example, four) driven timing pulleys 6*b*, and a timing belt 6*c* wound on these pulleys 6*a* and 6*b*. The transport mechanism 6 also includes two roller transport mechanisms disposed near opposite side edge portions of the upper transport path plate 4*a* (and hence the inserted bill P) and spaced from each other in a widthwise direction of the upper transport path plate 4*a*. Each of the roller transport mechanisms includes a plurality of (in the illustrated example, seven) driven rollers 6*d* disposed in opposed relation to the respective driven timing pulleys 6*b*.

The driving timing pulleys 6*a* of the two belt transport mechanisms are connected with each other via a connecting shaft 6*a*1, and a worm wheel 7 is mounted on the connecting shaft 6*a*1 so that rotational driving force of a transport motor M1, secured to the underside of the lower transport path plate 4*b*, is transmitted to the worm wheel 7 via a predetermined gear mechanism (worm gear mechanism in the illustrated example) 8. As the driving timing pulleys 6*a* are rotated by the transport motor M1 in a forward direction to thereby turn the timing belts 6*c* in a clockwise direction of FIG. 1, the bill P inserted in the insertion opening 2 comes to be sandwiched between the timing belts 6*c* and the driven rollers 6*d* and transported from the insertion opening 2 to the introducing portion 20*a*1 of the cumulative bill storage section 20 along the L-shaped transport path 4 while being kept in the sandwiched condition.

Adjacent to a downward bent portion of the bill transport path 4, there is provided a lever 9 for preventing the inserted bill from being forcibly pulled out of the handling apparatus by an illegal act of a malicious person. The pulling-out preventing lever 9 is pivotally mounted on the housing 1 in such a manner that it can project into the bill transport path 4 at an acute angle thereto along a transport direction X and thereby allow its distal end to be pressed against the surface of the bill P with predetermined pressing force. Because this preventing lever 9 presses relatively firmly the bill P against the path plate 4*b* at the acute angle along the transport direction X, even when someone attempts to pull out the inserted bill P through the insertion opening 2 while the inserted bill P is being temporarily held, in an intermediate portion of the transfer path 4, by the transport mechanism unit 6, the pulling force would cause the preventing lever 9 to bite deeper into the surface of the bill P. With the pulling-out preventing lever 9 operating in this manner, it is possible to reliably prevent the inserted bill P from being pulled out through the insertion opening 2. Note that the lever 9 is used not only for preventing the pulling out of the inserted bill P but also for detecting passage of the inserted bill P as will be later described.

Figure 2:
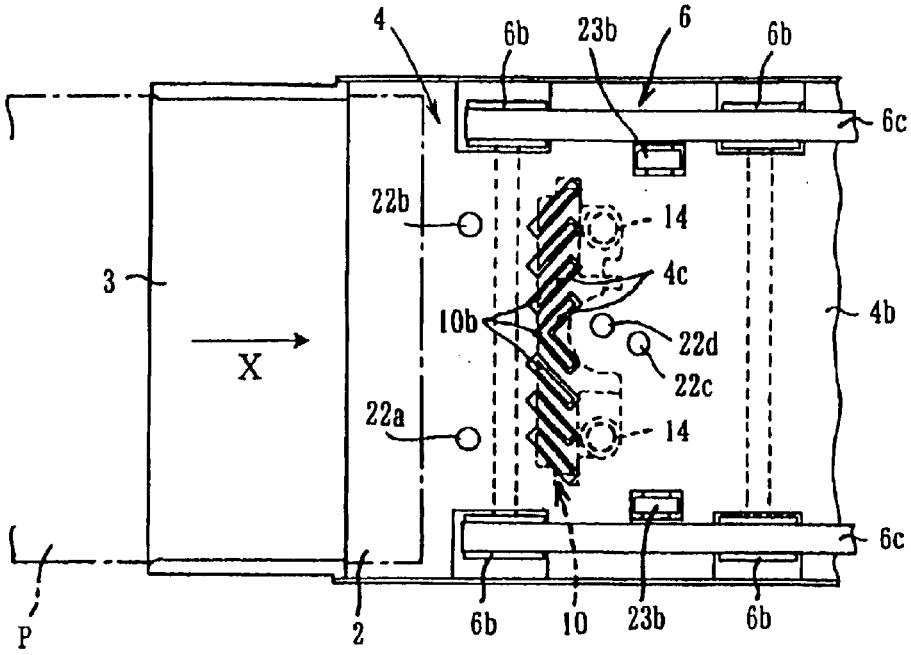
FIG. 2 is a plan view showing a bill transport path and a shutter in the bill handling apparatus of FIG. 1.

Between the transport path 4 and the cumulative bill storage section 20, there are provided the above-mentioned shutter 10 adjacent to the upstream-end driven timing pulley 6*b* and a stacker mechanism 11 adjacent to the cumulative bill storage section 20. The shutter 10 has a base portion 10*a* that is brought into and out of engagement with the stacker mechanism 11, and upward protrusions 10*b* for opening and closing (i.e., clearing and blocking) the transport path 4. As more clearly seen from FIG. 2 that is a plan view showing the bill transport path 4 and shutter 10, the shutter 10 is disposed between the respective timing belts 6*c* of the two belt mechanisms adjacent to the downstream end of the insertion opening 2. The base portion 10*a* is supported on a shutter support plate 12 for vertical movement to and from the transport path 4. Spring member (coil spring in the illustrated example) 14 is interposed between the shutter base portion 10*a* and the lower transport path plate 4*b*, so that the base portion 10*a* is normally resiliently biased, via the spring member 14, toward the stacker mechanism 11, i.e. in a direction (direction of gravity) to open the transport path 4.

The protrusions 10*b* of the shutter 10 comprise a substantially V-shaped central protrusion and two sets of straight protrusions located adjacent the central protrusion; the protrusions of one of the sets extend substantially in parallel to one of the slanted portions of the central protrusion while the protrusions of the other set extend substantially in parallel to the other slanted portion of the central protrusion. Each of the upper and lower transport path plates 4*a* and 4*b* has a plurality of holes 4*c* formed therethrough and corresponding in shape to the above-mentioned protrusions 10*b* of the shutter 10. The protrusions 10*b* of the shutter 10 are constructed to move in and out of the corresponding holes 4*c*, to thereby close and open the bill transport path 4. Namely, as a pantograph-shaped linkage 11*b* (to be later described) of the stacker mechanism 11 contracts, the base portion 10*a* of the shutter 10 comes into contact with an inner lift arm 11*d* of each of the linkage 11*b* at a given position thereof and is moved upward by the ascending inner lift arm 11*d* against the bias of the spring member 14 in such a manner that the protrusions 10*b* are moved through the holes 4*c* of the lower transport path plate 4*b* and into the holes 4*c* of the upper transport path plate 4*a* to thereby close the transport path 4. Conversely, as the pantograph-shaped linkage 11*b* expands, the base portion 10*a* of the shutter 10 gets apart from (i.e., is brought out of contact with) the descending inner lift arm 11*d* under the biasing force of the spring member 14 in such a manner that the protrusions are moved out of the holes 4*c* of the upper and lower transport path plates 4*a* and 4*b* to thereby open the transport path 4.

In the instant embodiment, the shutter 10 is normally biased toward the stacker mechanism 11, i.e. in the direction (direction of gravity) to open the transport path 4. Thus, the shutter 10 is allowed to promptly retract from the transport path 4 in response to the expanding movement of the linkage 11*b*. As will be later explained in detail, an eccentric cam 16 is connected to the linkage 11*b*, and the linkage 11*b* is caused to expand (fold) and contract (unfold) by a stack motor M2 rotating the eccentric cam 16 via a gear mechanism 19 and worm wheel 17. The stack motor M2 is controlled by a later-described control section 30, and even when a rotation stop instruction is given from the control section 30, a rotation shaft of the stack motor M2 continues to rotate for a while due to inertia of the motor M2. In such a case, although the linkage 11*b* slightly expands or contracts unnecessarily in response to the rotation of the rotation shaft caused by the inertia of the stack motor M2, the unnecessary expansion or contraction of the linkage 11*b* can be restrained, as a result of which the continued rotation of the rotation shaft due to the inertia of the stack motor M2 can be braked. Because the continued rotation of the rotation shaft due to the inertia of the stack motor M2 can be canceled by the biasing force of the spring member 14, the opening/closing operation of the shutter 10 can be executed with high accuracy under the control of the control section 30. As another example of the way to brake the continued rotation of the rotation shaft due to the inertia of the stack motor M2, the shutter 10 may be constructed to have a weight enough to restrain the unnecessary expansion or contraction of the linkage 11*b*. In this case too, the linkage 11*b* can be restrained from expanding or contracting to an unnecessary extent by virtue of the enough weight of the shutter 10, so that the continued rotation of the rotation shaft due to the inertia of the stack motor M2 can be appropriately braked and thus the opening/closing operation of the shutter 10 can be executed with high accuracy under the control of the control section 30.

The stacker mechanism 11 includes a stack plate 11*a* for pressing the inserted bill P, and the pantograph-shaped linkage 11*b* operatively coupled with the stack plate 11*a*. The linkage 11*b* includes a generally U-shaped outer lift arm 11*c* that is disposed below and in corresponding relation to the outer side edges of the lower transport path plate 4*b*, and an inner lift arm 11*d* that is located inwardly of parallel opposed arm portions of the outer lift arm 11*c* and disposed below and in corresponding relation to the middle portion of the lower transport path plate 4*b*. As illustratively shown in a plan view of FIG. 3, the outer lift arm 11*c* is generally in the form of an elongate frame extending along the outer side edges of the lower transport path plate 4*b* and having a transverse hole 11*c*1 formed centrally in each of the parallel opposed arm portions. The inner lift arm 11*d* is generally in the form of an elongate bar or plate having portions fitted in the respective transverse holes 11*c*1 of the outer lift arm 11*c*. The outer lift arm 11*c* and inner lift arm 11*d* are pivotally connected with each other by means of a pivot member 11*e* provided on a longitudinally-middle portion of either one of the outer lift arm 11*c* and inner lift arm 11*d*; in the illustrated example of FIG. 3, the pivot member 11*e* is in the form of a boss formed on the inner lift arm 11*d*.

The outer lift arm 11*c* is pivotally supported, at its one end closer to the insertion opening 2 (left end in the figure), by a transverse shaft 11*f*. The transverse shaft 11*f* extends in a widthwise direction of the lower transport path plate 4*b* and is secured at its opposite ends to a pair of left and right support plates 13 (denoted by dot-and-dash lines in FIG. 3), and the support plates 13 are in turn secured to the above-mentioned shutter support plate 12. At the other end, the outer lift arm 11*c* has left and right lateral bosses 11*g* slidably received in respective elongate holes 11*a*1 formed in the stack plate 11*a*. The inner lift arm 11*d* is pivotally supported, at its one end closer to the insertion opening 2 (left end in the figure), by the stack plate 11*a* via left and right lateral bosses 11*h*. At the other end, the inner lift arm 11*d* have left and right lateral bosses 11*i* slidably received in respective elongate holes 13*a* formed in the left and right support plates 13. As will be described below, a pair of left and right cam mounting sections 11*c*2 for mounting a pair of the left and right rotary eccentric cams 16 are provided on both sides of the outer lift arm 11*c*. Each of the cam mounting sections 11*c*2 has an elongate hole 11*c*3 extending in the longitudinal direction of the outer lift arm 11*c*. One such rotary eccentric cam 16 is slidably mounted in each of the elongate hole 11*c*3 by means of an eccentric pin 16*a*.

Figure 3:
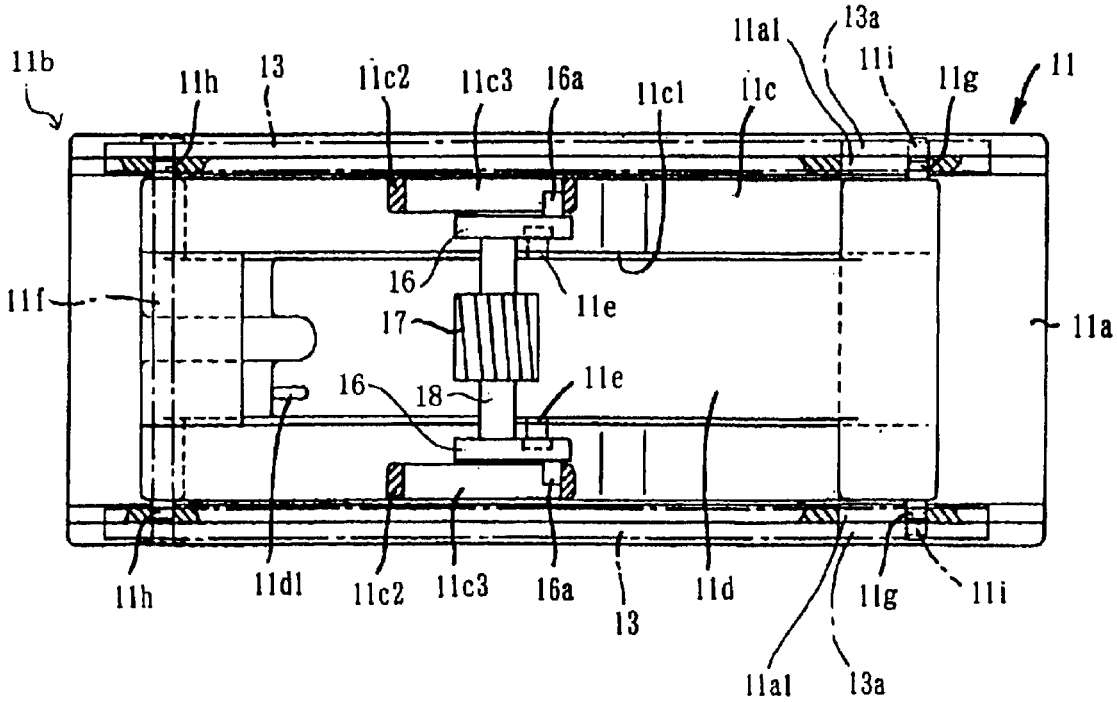
FIG. 3 is a plan view showing a linkage in the bill handling apparatus.

The left and right rotary eccentric cams 16, as seen in FIG. 3, are connected with each other via a connecting shaft 18 having the worm wheel 17 mounted thereon. To the worm wheel 17, there is transmitted, via the worm gear mechanism 19, the rotational driving force of the stack motor M2 mounted on the underside of the lower transfer path plate 4*b*. Each of the eccentric cams 16 is rotated from a predetermined initial position by almost 360 degrees in the clockwise (forward) direction of FIG. 1 by the stack motor M2 via the worm gear mechanism 19. As the rotary eccentric cams 16 thus rotate, the respective eccentric pins 16*a* of the cams 16 press the cam mounting sections 11*c*2 of the outer lift arm 11*c* downward toward the cumulative bill storage section 20, so that the outer lift arm 11*c* is caused to pivot in the clockwise direction about the shaft 11*f* adjacent to the insertion opening 2. As the outer lift arm 11*c* thus pivots in the clockwise direction, each of the eccentric pins 16*a* makes one reciprocation within the elongate hole 11*c*3 of the corresponding cam mounting section 11*c*2, each of the bosses 11*g* of the outer lift arm 11*c* makes one reciprocation within the corresponding elongate hole 11*a*1 formed in the stack plate 11*a*, and each of the bosses 11*i* of the inner lift arm 11*d* makes one reciprocation within the elongate hole 13*a* formed in the corresponding support plate 13. In this way, the outer lift arm 11*c* and inner lift arm 11*d* of the linkage 11*b* expand and contract about the pivot members 11*e*. By the outer lift arm 11*c* and inner lift arm 11*d* thus expanding and contracting, the stack plate 11*a* reciprocates vertically relative to the cumulative bill storage section 20.

The cumulative bill storage section 20 cumulatively stores the bills P sequentially supplied via the transport mechanism 6. Two elongate bill introducing guide members 20*a* are disposed immediately above the storage section 20 and spaced apart from each other by a predetermined distance slightly smaller than the width of the supplied bill P. These introducing guide members 20*a* together constitute the above-mentioned bill introducing portion 20*a*1 that functions to introduce the supplied bill P into the cumulative bill storage section 20. In the cumulative bill storage section 20, there is provided a bill compression plate 20*b* in substantially parallel relation to the introducing guide members 20*a* and stack plate 11*a* of the stacker mechanism 11. While the introducing guide members 20*a* are secured to the housing 1, the bill compression plate 20*b* is attached to a spring 20*c* secured to the bottom of the cumulative bill storage section 20. The bill compression plate 20*b*, which has a size corresponding to the surface of the bill P, is normally resiliently biased via the spring 20*c* upward toward the stack plate 11*a* and can be translated vertically toward and away from the stack plate 11*a*, i.e. in a direction substantially vertical to the surface of each bill P sandwiched between the stack plate 11*a* and the compression plate 20*b*.

As described above, the linkage 11*b* of the stacker mechanism 11 makes the extracting/contracting movement by the eccentric cams 16 being caused to turn by the stack motor M via the gear mechanism 19 and worm wheel 17; namely, as the eccentric cams 16 makes almost one complete rotation, the linkage 11*b* makes the extracting/contracting movement to thereby cause the stack plate 11*a* to vertically reciprocate in the cumulative bill storage section 20. In this manner, the stack plate 11*a* can cumulatively store each bill P, transported to the introducing portion 20*a*1, onto the compression plate 20*b*. When the apparatus is placed in the standby state, the eccentric cams 16 are each rotated a one-quarter turn and stopped in the rotated position, and the linkage 11*b* expands by an amount corresponding to the one-quarter turn and then is held stationary in a predetermined position where the stack plate 11*a* appropriately presses the bill P present in the introducing portion 20*a*1 and the shutter 10 opens the transport path 4. Although the shutter 10 clears the transport path 4 in the standby state of the apparatus, the bills P already cumulatively stored or stacked on the compression plate 20*b* can be pressed together between the compression plate 20*b* and the stack plate 11*a* with appropriate firmness. Thus, the bill P once stored or stacked on the compression plate 20*b* can be reliably prevented from being forcibly pulled out from the cumulative bill storage section 20 through the insertion opening 2 by use of, for example, a tape attached to the bill P. Further, when the stack plate 11*a* is pressing the bills P against the compression plate 20*b* in the storage section 20, there is produced a significant difference in level (height) between the stack plate 11*a* and the introducing portion 20*a*1 and hence between the stack plate 11*a* and the downstream end portion of the transport path 4, and this level difference between the stack plate 11*a* and the downstream end portion of the transport path 4 can impart sufficient resistance to the bill pulling force that is applied with the intent to pull the inserted bill P from the storage section 20 through the insertion opening 2 as by using the tape. Namely, because the bill P pressed by the stack plate 11*a* against the compression plate 20*b* is at a height considerably lower than the downstream end portion of the transport path 4, it is possible to prevent the unfair act of forcibly pulling the bill P from the cumulative bill storage section 20.

Further, because the stack plate 11*a* firmly presses the bills P against the compression plate 20*b* in the storage section 20, any one of the bills P once cumulatively stored or stacked on the compression plate 20*b* can be reliably prevented from projecting past the introducing guide members 20*a* back into the introducing portion 20*a*1, so that a succeeding bill P can be transported to the introducing portion 20*a*1 with no hindrance. Namely, if any one of the bills P cumulatively stored on the compression plate 20*b*, particularly the one at the top of the bill stack (last-stored bill), has a poor rigidity due to aging or is wrinkled, there is a likelihood that a central portion of the bill P bulges upward from the storage section 20 back into the introducing portion 20*a*1. In case the central portion of the bill P bulges into the introducing portion 20*a*1, the bulging central portion will abut the succeeding bill P transported via the transport mechanism 6 to the introducing portion 20*a*1 and prevent the succeeding bill P from being properly introduced into the introducing portion 20*a*1. To avoid such an inconvenience, it has been conventional to use a lever to firmly press the bill stack against the compression plate 20*b* so that none of the bills P projects upward into the introducing portion 20*a*1. The instant embodiment, on the other hand, is arranged such that the stack plate 11*a* presses the bill stack against the compression plate 20*b* to thereby prevent any of the bills P from undesirably projecting upward into the introducing portion 20*a*1, and thus the instant embodiment can eliminate the need for the separate pressing lever.

The gear mechanism 8 includes a pulse encoder 21 that detects rotational motion of the transport motor M1 and outputs a rotation detection signal (motor pulse). Specifically, the pulse encoder 21 outputs the rotation detection signal, by using a rotation-detecting optical sensor 21*b* to detect each rotation of a rotating plate 21*a* connected to a predetermined rotation shaft 8*a* of the gear mechanism 8.

At predetermined positions of the upper and lower transport path plates 4*a* and 4*b*, there are provided a plurality of (e.g., four) bill detecting sensors 22*a*–22*d* and a pair of sensors 23 for detecting ingredients of inks with which the bills P were printed. Each of the bill detecting sensors 22*a*–22*d* is a transmission-type sensor comprising a pair of light-emitting and light-receiving (opto-electronic transducing) elements provided in vertically opposed relation to each other with the transport path 4 interposed therebetween, which outputs an electric signal corresponding to an amount of light transmitted through the inserted bill P being transported along the transport path 4. Further, the individual bill detecting sensors 22*a*–22*d* are disposed at a plurality of predetermined different positions to detect transmitted-light amount patterns (i.e., amounts of light transmitted through printed designs, watermarks, etc.) of the bill P at the different positions. The bill detecting sensors 22*a*, 22*b* and sensors 22*c*, 22*d* are spaced from each other in the bill transport direction X with the shaft of the upstream-end driven timing pulley 6*d* and shutter 10 interposed therebetween. The ink-ingredient detecting sensors 23 are provided adjacent to two longitudinal side edges of the transport path 4 in opposed relation to each other, and each of the two ink-ingredient detecting sensors 23 comprises a magnetic head 23*a* and a pressing roller 23*b* vertically opposed to each other with the transport path 4 extending therebetween. The magnetic head 23*a* of each of the ink-ingredient detecting sensors 23 outputs electrical signals corresponding to the ink ingredients of the printed designs of the bill P pressed there against by the corresponding pressing roller 23*b*.

On the above-mentioned shutter support plate 12, there are provided a shutter switch (first detection means) 24 for detecting when the shutter 10 has cleared or opened the bill transport path 4, and a carrier switch (second detection means) 25 for detecting when the shutter 10 has blocked or closed the bill transport path 4 and also when the linkage 11*b* has contracted horizontally (i.e., unfolded) to a maximum degree to position the stack plate 11*a* above the introducing portion 20*a*1. The shutter switch 24 is a transmission-type sensor comprising a pair of light-emitting and light-receiving (opto-electronic transducing) elements that are provided on the underside of the shutter support plate 12 in opposed relation to each other with a shading portion 10*c* of the shutter base portion 10*a* interposed therebetween. The shutter switch 24 outputs an electric signal when the shading portion 10*c* has blocked the light emitted from the light-emitting element toward the corresponding light-receiving element. The carrier switch 25 is also a transmission-type sensor comprising a pair of light-emitting and light-receiving (opto-electronic transducing) elements that are provided on the underside of the shutter support plate 12 in opposed relation to each other with a shading portion 11*d*1 of the inner lift arm 11*d* of the linkage 11*b* interposed therebetween. The carrier switch 25 outputs an electric signal when the shading portion 11*d*1 has blocked the light emitted from the light-emitting element toward the corresponding light-receiving element.

Adjacent to the downward bent portion of the bill transport path 4, there is also provided a bill passage detecting sensor 26, which is a transmission-type sensor comprising a pair of light-emitting and light-receiving (opto-electronic transducing) elements that are provided on the apparatus casing 1 in opposed relation to each other with a shading portion 9*a* of the pulling-out preventing lever 9 interposed therebetween. The passage detecting sensor 26 outputs an electric signal when the shading portion 9*a* has blocked the light emitted from the light-emitting element toward the corresponding light-receiving element.

Further, adjacent to the bottom of the storage section 20, there is provided a full-state detecting sensor 27 for detecting when the storage section 20 has been filled with bills P to its capacity. The full-state detecting sensor 27 is a transmission-type sensor comprising a pair of light-emitting and light-receiving (opto-electronic transducing) elements that are provided on the apparatus casing 1 in opposed relation to each other with a shading portion 20*d* of the compression plate 20*b* interposed therebetween. The full-state detecting sensor 27 outputs an electric signal when the shading portion 20*d* has blocked the light emitted from the light-emitting element toward the corresponding light-receiving element.

Figure 4:
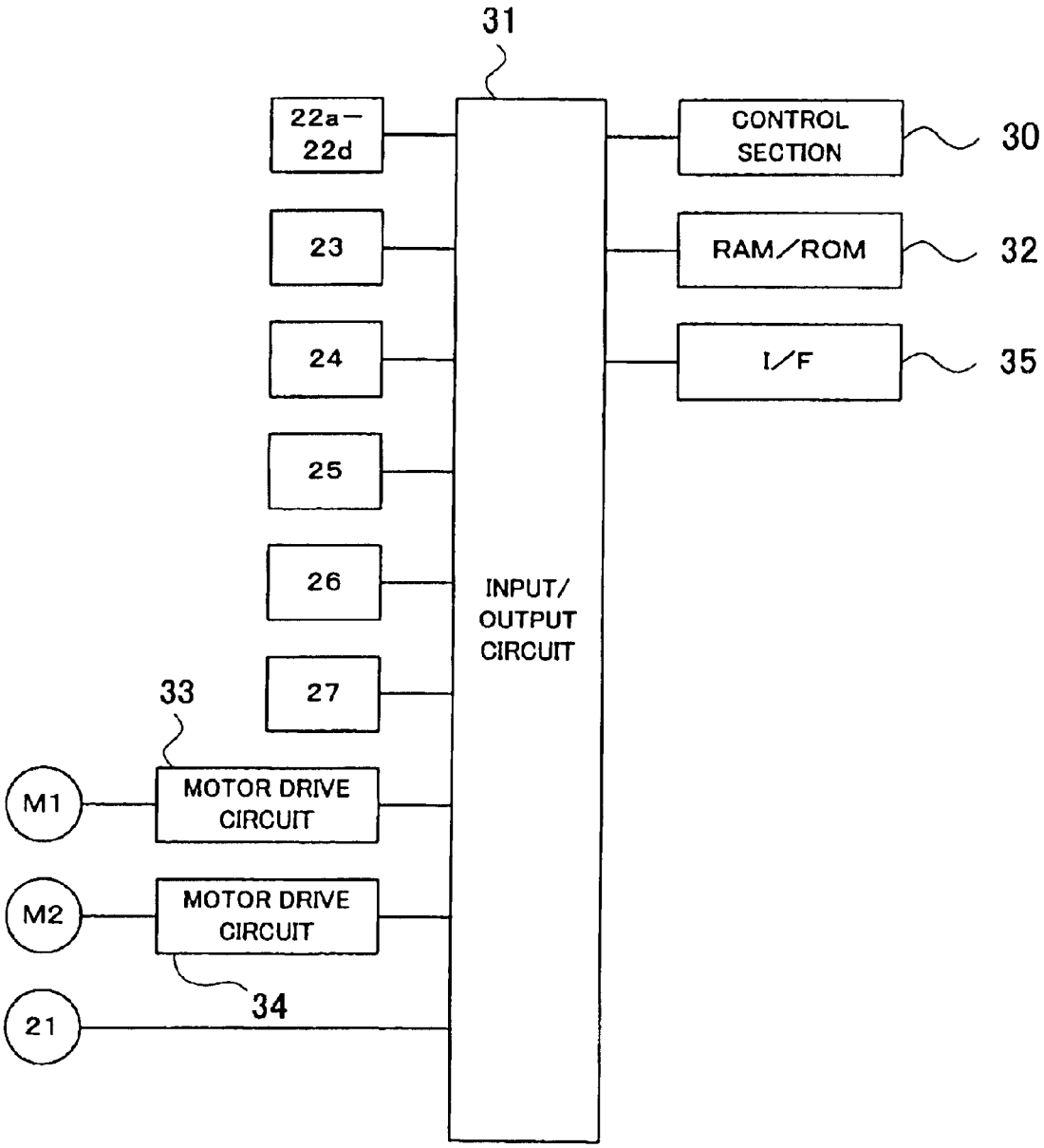
FIG. 4 is a block diagram showing an exemplary hardware setup of the bill handling apparatus shown in FIG. 1.

FIG. 4 is a block diagram showing an exemplary electric hardware setup of the bill handling apparatus shown in FIG. 1. In FIG. 4, respective output signals of the bill detecting sensors 22*a*–22*d*, ink-ingredient detecting sensors 23, shutter switch 24, carrier switch25, bill passage detecting sensor 26 and full-state detecting sensor 27 are passed, via A/D converters (not shown) and input/output circuit 31, to the control section 30. Memory 32, including a ROM and a RAM, stores various programs, information and data pertaining to sequential operations of the bill handling apparatus and various reference data necessary for identifying types, i.e. denominations, of bills P and testing the authenticity of the bills P. The control section 30, which comprises a CPU (Central Processing Unit), executes programs, stored in the memory 32, to carry out the sequenced operations of the handling apparatus and various processes, such as those for identifying the denominations of the bills P and testing the authenticity of the bills P. The transport motor M1 of the transport mechanism 6 is controlled by the control section 30 via a motor drive circuit 33 and input/output circuit 31. Similarly, the stack motor M2 of the stacker mechanism 11 is controlled by the control section 30 via a motor drive circuit 34 and input/output circuit 31. Each rotation detection signal from the pulse encoder 21 of the gear mechanism 8 is supplied to the control circuit 30 via the input/output circuit 31. Reference numeral 35 represents an input/output interface for communicating signals between the bill handling apparatus and the body of an automatic vending apparatus, money changer apparatus or the like provided with the bill handling apparatus.

Figure 5:
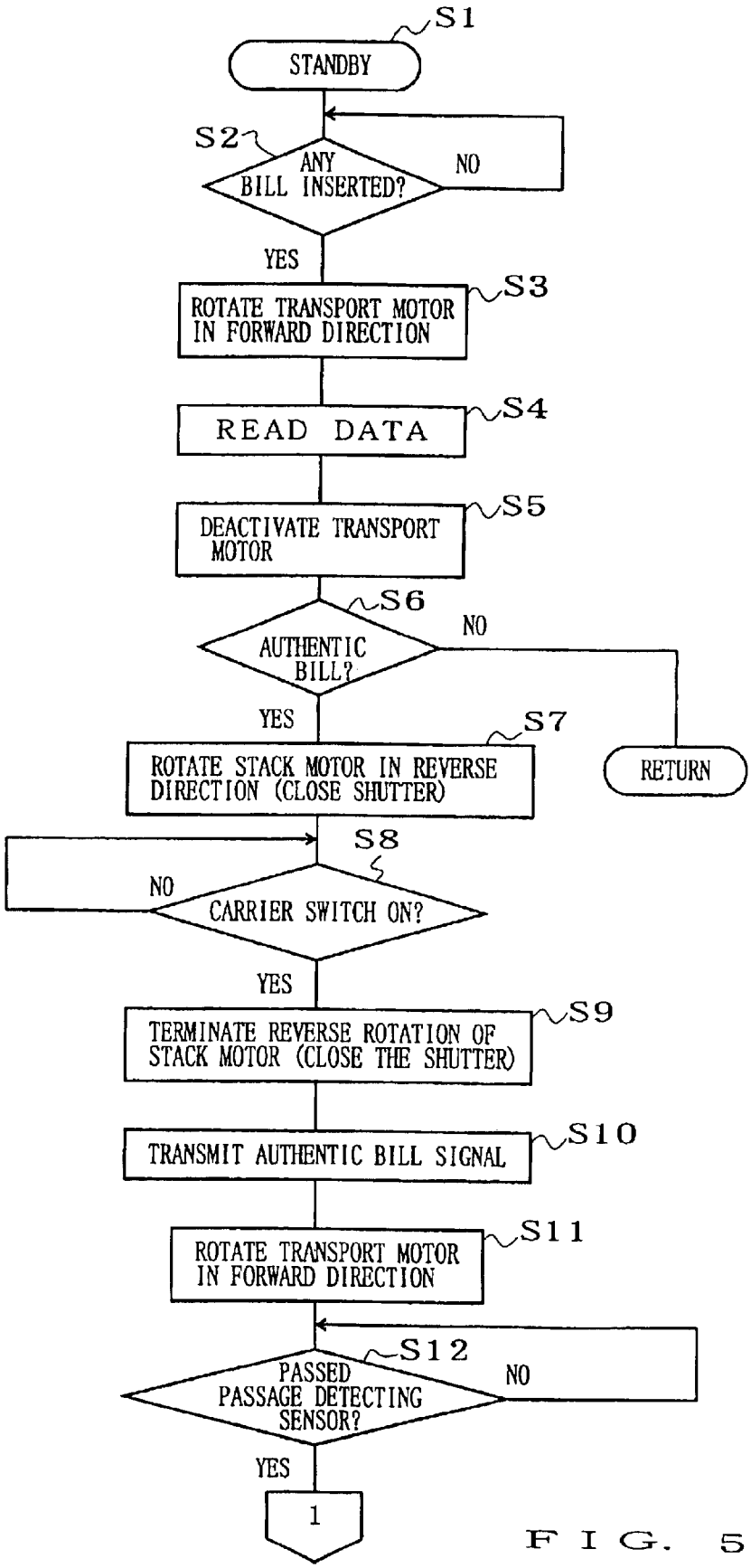
FIGS. 5 and 6 are flow charts showing an exemplary sequence of control operations carried out by a control section in the bill handling apparatus.
Figure 6:
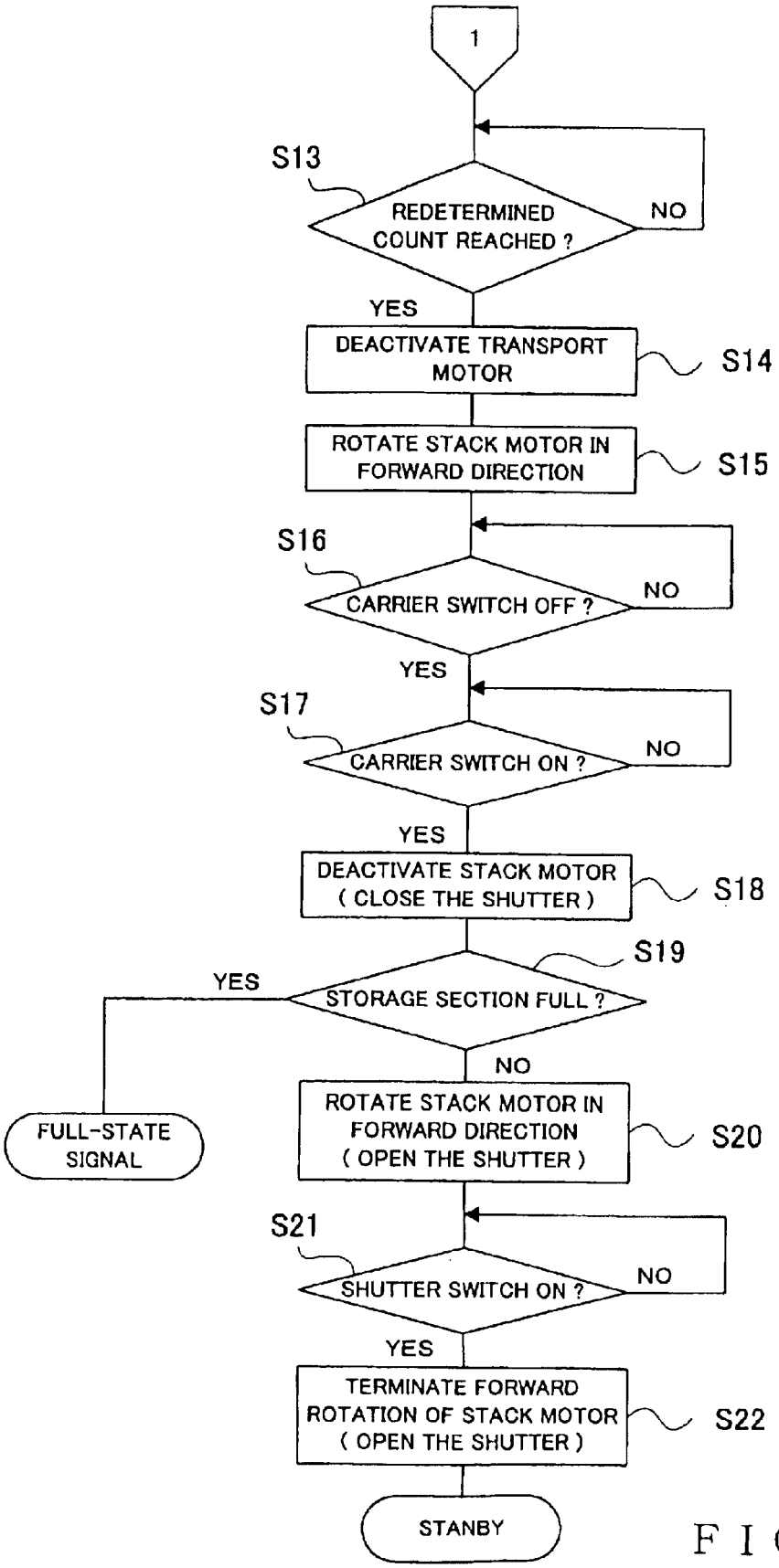
Figure 7:
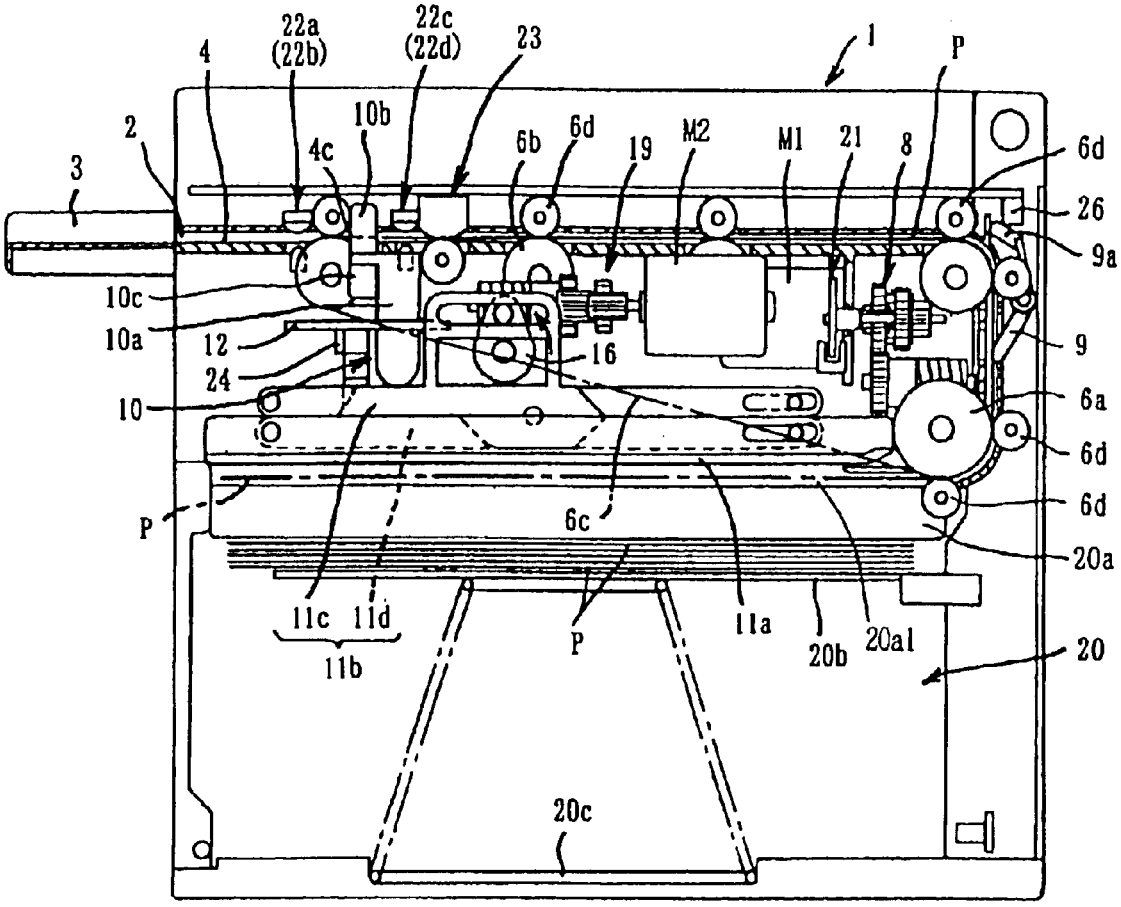
FIG. 7 is a view explanatory of a manner in which an inserted bill is temporarily held in an intermediate portion of the bill transport path.
Figure 8:
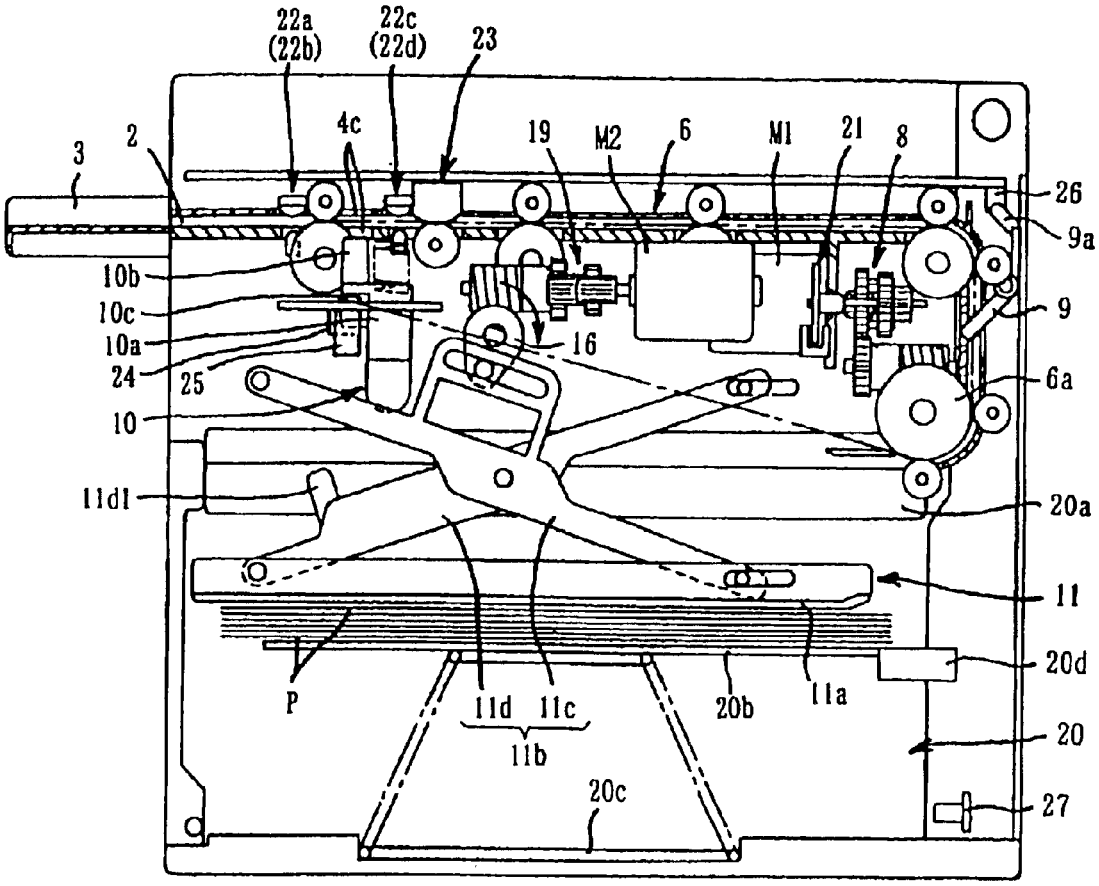
FIG. 8 is a view explanatory of stacking operations of a stacker mechanism in the bill handling apparatus.
Figure 9:
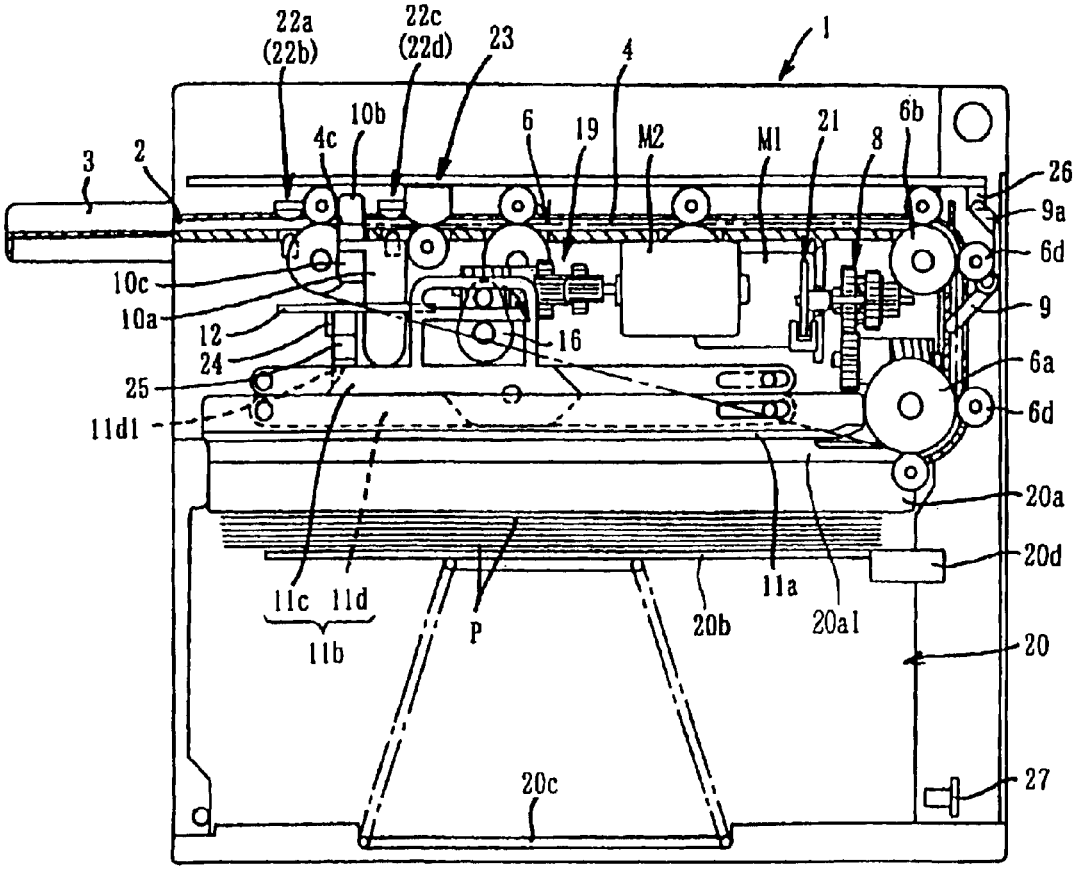
FIG. 9 is a view explanatory of a state after the stacking operations of the stacker mechanism have been completed.

Now, a description will be made about behavior of the bill handling apparatus constructed in the above-described manner, with reference to FIGS. 1 and 5–9. FIGS. 5 and 6 are flow charts showing control operations of the control section 30, FIG. 7 is a view explanatory of a state in which bills P are temporarily held in the storage section 20, FIG. 8 a view explanatory of stacking operations of the stacker mechanism 11, and FIG. 9 is a view explanatory of a state after the stacking operations of the stacker mechanism 11 have been completed.

In the standby state at step S1 of FIG. 5, which corresponds to the state shown in FIG. 1, the rotary eccentric cams 16 are held stationary in the position after having been rotated a one-quarter turn from its upright position by the forward driving operation or rotation of the stack motor M2 as indicated by an arrow of FIG. 1. In this state, the linkage 11*b* of the stacker mechanism 11 is in the expanded (folded) position such that the stack plate 11*a* presses bills P against the compression plate 20*b* of the storage section 20 (or presses the compression plate 20*b* if there is no bill P on the compression plate 20*b*) and the shutter 10 is in the position opening the bill transport path 4. Namely, the shutter base portion 10*a* is held in contact with the inner lift arm 11*d* of the linkage 11*b*, and the protrusions 10*b* of the shutter 10 are positioned out of the holes 4*c* of the upper and lower transport path plates 4*a* and 4*b* to thereby clear the bill transport path 4. Further, in this standby state, the shading portion 10*c* of the shutter 10 is in the position blocking the light emitted from the light-emitting element of the shutter switch 24. In this standby state with the shutter 10 clearing the bill transport path 4, a bill P can be inserted into the bill insertion opening 2.

Then, at step S2, a determination is made as to whether any bill P has been inserted into the insertion opening 2. If no bill P has been inserted, the control section 30 reverts to step S1, while if any bill P has been inserted, the control section 30 moves on to step S3. When a bill P has been inserted, the leading end of the inserted bill P is detected by the bill detecting sensors 22*a* and 22*b* located closer to the insertion opening 2 than the shutter 10, and respective detection signals output from the sensors 22*a* and 22*b* are passed to the control section 30. Thus, the control section 30 determines that the bill P has been inserted and causes the transport motor M1 to operate in the forward direction, at step S3. Consequently, the timing belts 6*c* of the transport mechanism 6 are driven in the forward direction, so that the bill P sandwiched between the timing belts 6*c* and driven rollers 6*d* is further transported along the transport path 4, as shown in FIG. 1.

At step S4, the control section 30 starts reading the data on the bill P. Namely, during the transport of the bill P, the control section 30 reads outputs from the bill detecting sensors 22*a*–22*d* and ink-ingredient detecting sensors 23, in synchronism with rotation detection signals (motor pulses), indicative of rotations of the transport motor M1, output from the pulse encoder 21.

At next step S5, the control section 30 terminates the forward rotation of the transport motor M1 on the basis of a count of the motor pulses from the pulse encoder 21. Namely, the motor pulses from the pulse encoder 21 are counted, and once the count of the motor pulses reaches a predetermined value, the control section 30 terminates the forward rotation of the transport motor M1. The predetermined count value represents a necessary number of the transport motor rotations for transporting the bill P to a predetermined position of the transport path 4 by the forward rotation of the transport motor M1 via the timing belts 6*c* and driven rollers 6*d*. Thus, the bill P is transported to the predetermined position of the transport path 4 via the timing belts 6*c* and driven rollers 6*d* before the forward driving operation of the transport motor M1 is terminated, and then temporarily held in that predetermined position by temporary termination of the forward driving operation of the transport motor M1, as shown in FIG. 7. In the instant embodiment, the bill P is temporarily held in the predetermined position of the path 4 between the driving timing pulleys 6*a* and ink-ingredient detecting sensors 23.

At step S6, the authenticity of the bill P is tested, using the conventional authenticity testing scheme, on the basis of the output detection data from the bill detecting sensors 22*a*–22*d* and ink-ingredient detecting sensors 23. As soon as the bill P is judged to be a false bill at step S6 ("NG" judgement), the transport motor M1 is activated to rotate in the reverse direction, so that the bill P temporarily held via the timing belts 6*c* and driven rollers 6*d* is transported back to the insertion opening 2 and then returned through the insertion opening 2. If, on the other hand, the bill P is judged to be an authentic or genuine bill at step S6 ("OK" judgement), then the control section goes to next step S7.

At step S7, the stack motor M2 is rotated in the reverse direction to bring the shutter 10 to the closing position. As shown in FIG. 7, as the stack motor M2 is rotated in the reverse direction, the eccentric cams 16 are caused to turn in an arrowed (counterclockwise) direction from the position shown in FIG. 1. Consequently, the linkage 11*b* of the stacker mechanism 11 contracts, so that the shutter 10 is raised with the base portion 10*a* abutted against the inner lift arm 11*d*.

Then, at step S8, it is determined whether the carrier switch25 has been turned on or not. As seen in FIG. 7, the shutter 10 is further raised by the inner lift arm lid as the linkage 11*b* contracts. At this stage, the linkage 11*b* contracts to the-maximum degree to thereby position the stack plate 11*a* above the introducing guide members 20*a*, i.e. the introducing portion 20*a*1, of the storage section 20. The shading portion 11*d*1, provided on the inner lift arm 11*d* of the linkage 11*b*, blocks the light emitted from the light-emitting element of the carrier switch 25, so that the carrier switch 25 is turned on to output a signal indicating that the linkage 11*b* has contracted to the maximum degree. At that time, the protrusions 10*b* of the shutter 10 project into the holes 4*c* of the upper and lower transport path plates 4*a* and 4*b* to thereby block the bill transport path 4, and a signal indicative of the blockage of the path 4 is output to the control section 30. If the carrier switch 25 is ON as determined at step S8, the control section goes to step S9.

At step S9, the reverse driving operation or rotation of the stack motor M2 is terminated, and thus the eccentric cams 16 are stopped in the position shown in FIG. 7. Because the contracting movement of the linkage 11*b* is terminated upon termination of the reverse rotation of the stack motor M2, the shutter 10 is kept in the position to block the bill transport path 4.

Then, the control section 30 transmits, to a predetermined circuit, a signal indicating that the inserted bill P is an authentic bill at step S10, and then causes the transport motor M1 to rotate in the forward direction at step S11. The forward driving operation of the transport motor M1 causes the timing belts 6*c* to rotate in the forward rotation, so that the bill P temporarily held by the timing belts 6*c* and driven rollers 6*d* is again transported toward the storage section 20.

At step S12, a determination is made as to whether the bill P has passed the passage detecting sensor 26. Once the bill P has come to the downward bent portion of the bill transport path 4, the pulling-out preventing lever 9 contacts the bill P and turns counterclockwise so that the shading portion 9*a* moves away from the passage detecting sensor 26 as shown in FIG. 7. As long as the bill P is temporarily held by the timing belts 6*c* and driven rollers 6*d*, the shading portion 9*a* is kept out of the sensing range (optical path) of the detecting sensor 26. However, as the bill P is again transported toward the introducing portion 20*a*1 of the storage section 20 through the operation at step S11, the bill P is brought out of contact with the lever 9, and thus the lever 9 returns to the original position as shown in FIG. 1 where the shading portion 9*a* is opposed to the passage detecting sensor 26 to block the light emitted from the light-emitting element of the sensor 26. Thus, when the passage detecting sensor 26 is outputting no signal, the control section 30 determines that the bill P has not yet passed the sensor 26 (NO determination at step S12), while when the sensor 26 outputs a signal, the control section 30 determines that the bill P has passed the sensor 26 (YES determination at step S12). With the affirmative (YES) determination at step S12, the control section 30 moves on to step S13.

At step S13, it is further determined whether the count of the rotation detection signals (motor pulses) output from the pulse encoder 21 in response to the forward driving operation of the transport motor M1 have reached the predetermined count value. As stated above, the predetermined count value represents the necessary number of transport motor rotations for transporting the bill P to the predetermined position of the transport path 4 by the forward rotation of the transport motor M1 via the timing belts 6*c* and driven rollers 6*d*. Thus, if the rotation detection signals output from the pulse encoder 21 have not reached the predetermined count value (NO determination at step S13), the bill P is transported from the temporarily held position denoted by solid line in FIG. 7 to a stack position denoted by dot-and-dash line in FIG. 7, i.e. to the bill introducing portion 20*a*1 of the storage section 20*a*. If, on the other hand, the rotation detection signals output from the pulse encoder 21 have reached the predetermined count value (YES determination at step S13), the control section 30 moves on to step S14.

At step S14, the forward rotation of the transport motor M1 is terminated. Namely, the forward rotation of the transport motor M1 is terminated when the bill P has been transported from the temporarily held position denoted by solid line in FIG. 7 to a stack position denoted by dot-and-dash line in FIG. 7, i.e. to the bill introducing portion 20*a*1 of the storage section 20*a*.

Then, at step S15, the stack motor M2 is rotated in the forward direction. The forward driving operation of the stack motor M2 causes the eccentric cams 16 to turn in the forward or clockwise direction as arrowed in FIG. 8. Thus, the linkage 11*b* of the stacker mechanism 11 expands from the position shown in FIG. 7, so that predetermined stacking operations for storing the bill P into the storage section 20 are initiated.

As stated above, the linkage 11*b* is arranged to perform one reciprocating movement, in response to almost one rotation of the eccentric cams 16, for cumulatively storing each bill P on the compression plate 20*b* of the storage section 20. Therefore, it is necessary to detect such one reciprocating movement of the linkage 11*b* corresponding to the rotation of the eccentric cams 16. The reciprocating movement of the linkage 11*b* is detected at steps S16 and S17 as follows.

At step S16, it is determined whether the carrier switch 25 has been turned off. Namely, as shown in FIG. 8, the expanding movement of the linkage 11*b* lowers the stack plate 11*a* to depress the bill P, present in the introducing portion 20*a*1 or on the introducing guide members 20*a*, toward the bottom of the storage section 20. As the linkage 11*b* further expands, the shading portion 11*d*1 of the inner lift arm 11*d* gets out of the sensing range (optical path) of the carrier switch 25, and the stack plate 11*a* further depresses the bill P, beyond the introducing guide members 20*a*, onto the compression plate 20*b* or one or more other bills P already stacked on the compression plate 20*b*. In this way, the newly inserted bill P can be stored on the compression plate 20*b*. Once the shading portion 11*d*1 of the inner lift arm 11*d* gets out of the sensing range of the carrier switch 25 during the expanding movement of the linkage 11*b*, the carrier switch 25 is turned off to signal the control section 30 that the linkage 11*b* has initiated the stacking operations. If the carrier switch 25 has been turned off as determined at step S16, the control section 30 proceeds to next step S17.

Note that as the linkage 11*b* expands, the shutter base portion 10*a* gets apart from the inner lift arm 11*d*, so that the shutter 10, normally urged downward by the spring 14 against the shutter support plate 12, retracts out of the transport path 4 to temporarily clear the transfer path 4.

At step S17, it is determined whether the carrier switch 25 has been turned on. Namely, when the eccentric cams 16 further rotate in the arrowed forward direction from the position shown in FIG. 8, the linkage 11*b* starts contracting horizontally (i.e. unfolding). Once the linkage 11*b* has contracted to the maximum degree due to the rotation of the eccentric cams 16, the shading portion 11*d*1 of the inner lift arm 11*d* gets out of the sensing range of the carrier switch 25 as shown in FIG. 9, so that the carrier switch 25 is turned on to signal the control section 30 that the stacker mechanism 11 has completed the stacking operations. The shutter 10 is raised due to the contracting movement of the linkage 11*b* by its base portion 10*a* being pressed upward by the inner lift arm 11, and thus the protrusions 10*b* of the shutter 10 project into the transport path 4 to block the path 4. If the carrier switch 25 has been thus turned on as determined at step S17, the control section 30 goes to step S18.

At step S18, the forward rotation of the stack motor M2 is terminated, in response to which the eccentric cams 16 stop rotating at a position shown in FIG. 9. Thus, the linkage 11*b* stops its contracting movement, so that the shutter 10 is kept in the position to block the bill transport path 4.

At step S19, a further determination is made as to whether the storage section 20 has been filled with bills P to its capacity. Namely, once the compression plate 20*b* depressed by the linkage 11*b* blocks the light emitted from the light-emitting element from the full-state detecting sensor 27, the sensor 27 is turned on to signal the control section 30 that the storage section 20 has been filled with bills P to its capacity. In response to the full-state detection signal from the full-state detecting sensor 27, the control section 30 outputs a full-state signal to a predetermined circuit. If, however, the storage section 20 has not yet been filled with bills P to its capacity (NO determination at step S19), the control section proceeds to step S20.

At step S20, the control section 30 causes the stack motor M2 to rotate in the forward direction in such a manner that the shutter 10 retracts from and clears the transport path 4. As the stack motor M2 rotates in the forward direction, the eccentric cams 16 rotate in the arrowed forward direction of FIG. 9 so that the linkage 11*b* horizontally expands or folds, in response to which the shutter 10 starts retracting from the transport path 4 while being kept in contact with the inner link 11*d*.

Then, it is determined at step S21 whether the shutter switch 24 has been turned on. Namely, in response to the expanding movement of the linkage 11*b*, the shading portion 10*c* of the shutter 10 blocks the light emitted from the light-emitting element of the shutter switch 24, upon which the switch 24 is turned on to signal the control section 30 that the shutter 10 has now cleared the transport path 4. With the affirmative determination at step S21, the control section 30 moves on to step S22.

At step S22, the control section 30 terminates the forward driving operation of the stack motor M2, so that the rotary eccentric cams 16 are brought to a stop in the position after having been rotated a one-quarter turn from the upright position shown in FIG. 9 and thus the linkage 11*b* also stops its expanding movement. At this stage, the linkage 11*b* has expanded to the extent that the stack plate 11*a* depresses the bill P against the compression plate 20*b* and the shutter 10 completely clears the transport path 4. As a consequence, the bill handling apparatus is returned to the standby state as shown in FIG. 1.

It should be appreciated that the stack motor M2, used in the above-described embodiment as the drive source to drive the stacker mechanism 11 and shutter 10, may be a stepping motor or solenoid operatively connected with the stacker mechanism 11 to permit the expanding/contracting movement of the linkage 11*b*.

Further, whereas the pantograph-shaped linkage 11*b* has been described above as composed of a pair of the links 11*c* and 11*d*, it may be composed of two such pairs of the links 11*c* and 11*d*.

Furthermore, although the shutter 10 has been described as blocking and clearing the bill transport path 4 by being brought into and out of contact with the linkage 11*b* in response to the contraction and expansion of the linkage 11*b*, the shutter 10 may be mechanically coupled to the linkage 11*b* for the transfer-path blocking and clearing purposes.

In summary, the present invention is characterized in that a single drive (motor M2) is shared between the stacker mechanism for cumulatively storing a paper-like piece into the storage section and the shutter for blocking and clearing the transport path. With this arrangement, the present invention can significantly reduce the number of necessary component parts and overall cost of the paper-like piece handling apparatus.

What is claimed is:

1. A paper sheet handling apparatus comprising:

transport means for transporting, along a transport path, a sheet inserted through an insertion opening;

transport path opening/closing means for closing or opening said transport path at a given enroute point of said transport path;

sheet evaluation means for evaluating authenticity of the inserted sheet during transport of the sheet along said transport path;

stacker means for storing the evaluated sheet into a cumulative sheet storage section; and drive means for driving said stacker means and said transport path opening/closing means.

2. A sheet handling apparatus as claimed in claim 1, wherein said stacker means includes a pressing member for pressing the evaluated sheet into said cumulative sheet storage section, a linkage mechanism capable of expanding/contracting movement by being driven via said drive means to reciprocate said pressing member relative to said cumulative sheet storage section, and wherein said transport path opening/closing means is movable in accordance with the expanding/contracting movement of the linkage mechanism to open or close said transport path.

3. A sheet handling apparatus as claimed in claim 2, wherein said linkage mechanism is driven to expand or contract via said drive means in such a manner that, in a standby state ready to accept a next sheet through said insertion opening, said pressing member presses the evaluated sheet into said cumulative sheet storage section and said transport path opening/closing means opens said transport path.

4. A sheet handling apparatus as claimed in claim 2, further comprising:

first detection means for detecting that said transport path opening/closing means has opened said transfer path; and second detection means for detecting a condition where said linkage mechanism has contracted to position said pressing member of said stacker means above an introducing guide portion of said cumulative sheet storage section, wherein a condition where said transport path opening/closing means has closed said transfer path is also detected in response to detection, by said second detection means, of the condition where said linkage mechanism has contracted.

5. A sheet handling apparatus as claimed in claim 2, wherein said transport path opening/closing means is brought into or out of contact with said linkage mechanism in accordance with the contracting or expanding movement of said linkage mechanism, to thereby close or open said transport path.

6. A sheet handling apparatus as claimed in claim 2, wherein said transport path opening/closing means is mechanically coupled to said linkage mechanism to close or open said transport path in accordance with the contracting/expanding movement of said linkage mechanism.

7. A sheet handling apparatus as claimed in claim 1, further comprising bias means for normally biasing said transport path opening/closing means in a direction to open said transport path.

8. A sheet handling apparatus as claimed in claim 1, wherein said transport path opening/closing means has a weight that biases said transport path opening/closing means in a direction to open said transport path.

9. A sheet handling apparatus as claimed in claim 2, wherein said linkage mechanism is driven to expand or contract by said drive means via rotary eccentric cams.

10. A method of brief opening/closing a transport path in a sheet handling apparatus comprising: transport means for transporting, along said transport path, a sheet inserted through an insertion opening; transport path opening/closing means for closing or opening said transport path at a given enroute point of said transport path; sheet evaluation means for evaluating authenticity of the inserted sheet during transport of the sheet along said transport path; stacker means for storing the evaluated sheet into a cumulative sheet storage section; and drive means for driving said stacker means and said transport path opening/closing means, said method comprising the steps of:

evaluating with the sheet evaluation means the authenticity of the inserted sheet during transport of the sheet along said transport path;

temporarily holding the sheet in an intermediate position of the transfer path after a trailing end of said sheet being transported along the transport path has passed the location of said transport path opening/closing means;

driving said stacker means via said drive means to move said stacker means to a predetermined stack standby position while the sheet is temporarily held in the intermediate position, and closing with said transport path opening/closing means said transport path in response to the driving via said drive means;

transporting the temporarily held sheet from said intermediate position to a predetermined stacking position; and stacking the sheet from the predetermined stacking position into said cumulative sheet storage section by driving said stacker means via said drive means to move said stacker means from said predetermined stack standby position toward said cumulative sheet storage section, and opening with said transport path opening/closing means said transport path in response to the driving via said drive means.

* * * * *